US006120675A

United States Patent [19]

Hill et al.

[11] Patent Number: 6,120,675

[45] Date of Patent: Sep. 19, 2000

[54] ELECTROCHEMICAL METHOD AND ELECTRODE

[75] Inventors: Andrew Hill, Nottingham; Peter Charles Steele Hayfield, Bickenhill, both of United Kingdom

[73] Assignee: Atraverda Limited, Sheffield, United Kingdom

[21] Appl. No.: 09/142,390

[22] PCT Filed: Jan. 31, 1997

[86] PCT No.: PCT/GB97/00293

§ 371 Date: Oct. 6, 1998

§ 102(e) Date: Oct. 6, 1998

[87] PCT Pub. No.: WO97/29220

PCT Pub. Date: Aug. 14, 1997

[30] Foreign Application Priority Data

Feb. 9, 1996 [GB] United Kingdom ..... 9602620

[51] Int. Cl.[7] ..... C23F 13/00

[52] U.S. Cl. ..... 205/734; 205/724; 204/196.08; 204/196.04; 204/196.1; 204/196.16; 204/196.18; 204/196.3; 204/280

[58] Field of Search ..... 204/196.08, 196.04, 204/196.1, 196.16, 196.17, 196.18, 196.3, 280; 205/734, 724

[56] References Cited

U.S. PATENT DOCUMENTS

| | | | |
|---|---|---|---|
| 2,863,819 | 12/1958 | Preiser | 204/196 |
| 3,038,849 | 6/1962 | Preiser | 204/196 |
| 4,486,288 | 12/1984 | Linder | 204/196 |
| 4,710,644 | 12/1987 | Baach | 307/95 |
| 4,872,957 | 10/1989 | Dong et al. | 204/84 |
| 4,966,675 | 10/1990 | Steininger | 204/290 |
| 5,141,607 | 8/1992 | Swiat | 205/234 |

FOREIGN PATENT DOCUMENTS

| | | |
|---|---|---|
| 0047595 | 3/1982 | European Pat. Off. . |
| 0 186334 | 7/1986 | European Pat. Off. . |
| 0443230 | 8/1991 | European Pat. Off. . |
| 0478152 | 4/1992 | European Pat. Off. . |
| 2001102 | 1/1979 | United Kingdom . |
| 2111079 | 6/1983 | United Kingdom . |
| WO 92/10597 | 6/1992 | WIPO . |

OTHER PUBLICATIONS

WPI Accession No. 79–20713 B/11—Abstract—JP 54015475 (Mitsubishi) no month/year available.

WPI Accession No. 79–766640 B/42—Abstract—SU 643551 (Nasonov) no month/year available.

*Primary Examiner*—Bruce F. Bell

*Attorney, Agent, or Firm*—Cesar, Rivies, Bernstein, Cohen & Pokotilow, Ltd.

[57] ABSTRACT

An electrochemical electrode of a tube of porous titanium suboxide with a contact connection to an electrical supply.

8 Claims, 2 Drawing Sheets

ELECTROCHEMICAL METHOD AND ELECTRODE

FIELD OF THE INVENTION

The invention relates to an electrochemical method and an electrode thereof The invention can be applied to a wide variety of uses. It is particularly effective in the treatment of reinforced concrete. Such concrete comprises a steel bar reinforcing framework swithin a body of set concrete. Other uses will be described below.

BACKGROUND OF THE INVENTION

It is known to connect such framework to a source of direct current to apply a voltage sufficient to maintain the metal in a corrosion resistant state, to avoid or treat corrosion. Such a system is called cathodic protection.

Generally this technique utilises a distributed anode system such as metal mesh, or conductive coatings such as paints and speciality gunited and sprayed material. There are however some areas which cannot be addressed in this way and "discrete" or "point" anodes are suggested. There are already two basic types of point anodes on the market. the most common being a platinised titanium rod. The other type is generally a shaped titanium mesh or titanium metal tube or plate, catalysed with an appropriate or mixed metal oxide based material.

The platinised titanium rod cannot be used alone however, because at the current ratings required (which are controlled by the density of the steel bars in the vicinity), the current density at the anode surface would be very high, generating acid at a rate far faster than it could diffuse away (and ultimately be neutralised by the alkali generated on the cathodic reinforcing bars). Hence the concrete would be destroyed by acid attack in the neighbourhood of the anode. The US National Association of Corrosion Engineers have a guideline that the current density should be no higher than 100 A./$m^2$ of concrete area to avoid this phenomenon. The rod is usually put in a significantly larger hole (typically 12 mm diameter) than would otherwise be required and the void is filled with a carbon based conductive paste to increase the surface area and hence reduce the current density at the concrete surface. For cost reasons however they still tend to be run well above the NACE guidelines.

At current densities above 0.3 mA.cm length (about 800 mA/$m^2$) the carbon backfill is consumed by anodic oxidation forming $CO_2$. As a result the contact between the carbon and the concrete is lost and the voltage to drive the protecting current rises, often outstripping the rating of the rectifier. In addition to this though, other mechanisms are possibly taking place. The high current flows generate gases, typically oxygen with traces of chlorine or carbon dioxide from the oxidation of the carbonaceous paste at the anode surface and this may have difficulty escaping, causing blowholes further reducing the contact at the concrete surface. (It is known that at very high current densities (around 15 $Am^2$) the anodes can "gas block" within hours of being powered up.)

Generally, because of the need to attend to a specialised conductive carbonaceous grout, the rod is restricted to anodes near the surface. Often there is steel work buried deep within the structure which would be assisted with a local anode close by.

OBJECTS OF THE INVENTION

It is an object of the invention to provide a more convenient and advantageous point electrode for use in the treatment of reinforced concrete and other electrochemical applications.

BRIEF SUMMARY OF THE INVENTION

In one aspect the invention provides an electrochemical electrode for use in electrochemical treatment of reinforced concrete or the like, the electrode comprising a wall comprising a porous material having an external and internal surface, a supply conductor being, in use, in electrical contact with the internal surface and with a supply of electric current.

The wall may be of any appropriate three dimensional shape, typically a cylinder or sphere. Because the connection of the conductor is connected to the internal surface of the wall anodic corrosion is avoided. The external surface will be corrosion resistant.

The wall is preferably shaped so that the electrode is tubular, i.e. open at both ends to define a gas transfer passage or channel.

The wall is porous to allow for ingress of gas into the passage; the porosity is selected so that any later applied grout or back filling does not significantly impede the gas passage.

Preferably the wall is formed of a porous titanium suboxide. Preferably the titanium suboxide is of the formula $TiO_x$ where x is 1.55 to 1.95. As indicated below, other porous materials may be used, and the electrode assembly may be used for other electrochemical processes.

Preferably the conductor extends through a bore in the electrode, e.g. through end caps in a generally cylindrical form. Most preferably a sheath extends beyond each end of the cylinder to convey released gases away from the electrode surface.

In another aspect, the invention provides a method for electrochemical treatment of reinforced concrete or the like, the method comprising exposing the reinforcement, locating an electrode adjacent a selected portion of the reinforcement, the electrode comprising a wall formed of porous material and having an external and internal surface, and connecting the internal surface of the wall to a supply of electric current.

Preferably the internal surface of the wall is connected to a supply conductor connected to the supply of electric current. The method preferably includes passing the conductor through the electrode, and through a sheath extending beyond each end of the electrode.

Preferably the hole drilled in the concrete is dimensioned much the same as the electrode (because there is no need to increase the surface area by including a body of conductive paste).

The advantages of the electrode of the invention are that it offers an effective but simple connection method to any tubular anode. Being tubular the Faradaic field inside the tube is insignificant and there is therefore no driving force for anodic corrosion of the metal within the tube. The metal inside the tube can therefore be selected solely on chemical corrosion considerations.

Detailed electrode designs according to the invention can be very simple and fabricated in the field. In one embodiment all that is required is a spot welder and an insertion tool. This means that the electrodes can be located on-site after comparison with the actual layout of the holes and reinforcing bars, in the case of anodes for cathodic protection.

Because special conductive grouts are not needed and the gas generated by the anodic reaction can easily be removed from the anode surface, the electrodes can be located deep down holes and back-filled with a conventional pumpable grout, which will not need replacing, especially if it has a high content of alkali or other reactant for the concrete.

The connection system also means that more than one electrode can be attached to the supply conductor, e.g. a feeder wire, enabling current to be distributed at different depths down the hole. This has the advantage of ensuring the cathodic current density does not get too high which would cause hydrogen embrittlement of the steel bars. Other options are ring-mains of electrodes and horizontal strings let into channels of slabs and soffits; and the like. Such strings and ring mains may also be useful in protecting such items as underground pipelines or storage vessels. Such electrode assemblies may be useful in other electrochemical techniques such as in-situ remediation and in general.

The most obvious advantage however, is that by provision of a suitable sheath, the anodic gases can be safely conducted away along the line of the feed wire, reducing the probability of loss of electrical contact from this cause, especially at high current densities.

This device is not only applicable to titanium suboxide but elements of it are applicable to any cylindrical/spherical perhaps porous structure (e.g. titanium metal foam—incorporating an electrocatalyst). The cylinders can be made in a variety of dimensions to adjust the current density appropriately. So by ease of adjusting the current density, lack of consumed carbonaceous backfill ability to remove the gaseous products, ability to install alkalinity grouts (these last three items indicating the possibility of higher current densities being tolerated) and flexibility of anode location the invention is particularly useful.

Other advantages of the invention are that:

1. the internal connection inside a tube eliminates anodic corrosion of the connector;
2. ease of assembly and flexibility of design;
3. provides facilities for gas removal; and
4. simplicity of contact allowing for several anodes on one string.

BRIEF DESCRIPTION OF THE DRAWINGS

In order that the invention may be well understood it will now be described by way of example with reference to the accompanying diagrammatic drawings, in which.

DETAILED DESCRIPTION OF THE INVENTION

Figure 1:
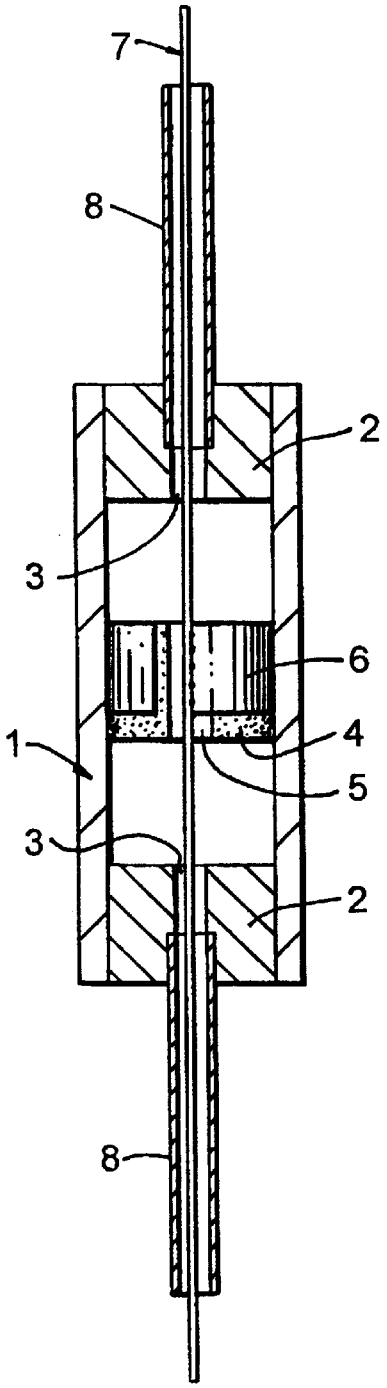
FIG. 1 is a longitudinal section through one anode of the invention.
Figure 2:
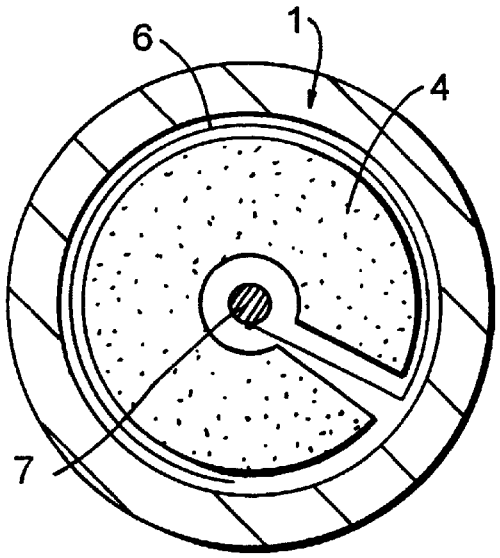
FIG. 2 is a view from one end of the anode.

The anode comprises a cylinder 1 having a wall formed of porous material, typically a titanium suboxide of the general formula $TiO_x$ where x is 1.55 to 1.95. (Such material can be made by any process of our patents, e.g. EP-A-0047595 and EP-A-0478152, provided that care is taken to induce porosity).

The cylinder contains end caps 2 containing through bores 3. The cylinder 1 also contains a connector 4, made of silicon rubber or the like having a bore 5 and which carries a strip 6 of typically titanium metal and which presses it against the internal surface of the cylinder 1. The strip is connected typically by spot welding to a feeder wire 7, extending through the cylinder and connected to a source of electric current (not shown). The feeder wire is housed in sheath 8, typically of a plastic material, beyond the cylinder. One such cylinder may be connected to another so that a ladder of such anodes is formed (see FIG. 4), each anode being associated with a different area of the reinforcement.

Figure 3:
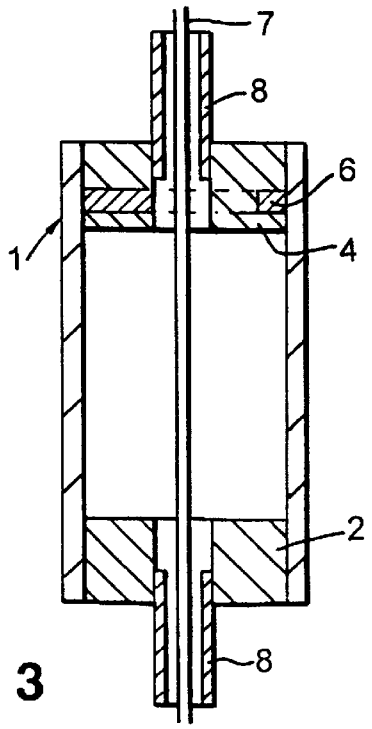
FIG. 3 is a longitudinal section through another anode of the invention.

The arrangement of the end plugs and connector may be varied as shown in the embodiment of FIG. 3. One end cap can be replaced by a cap without a through bore for the single final anode in a ladder assembly.

Figure 4:
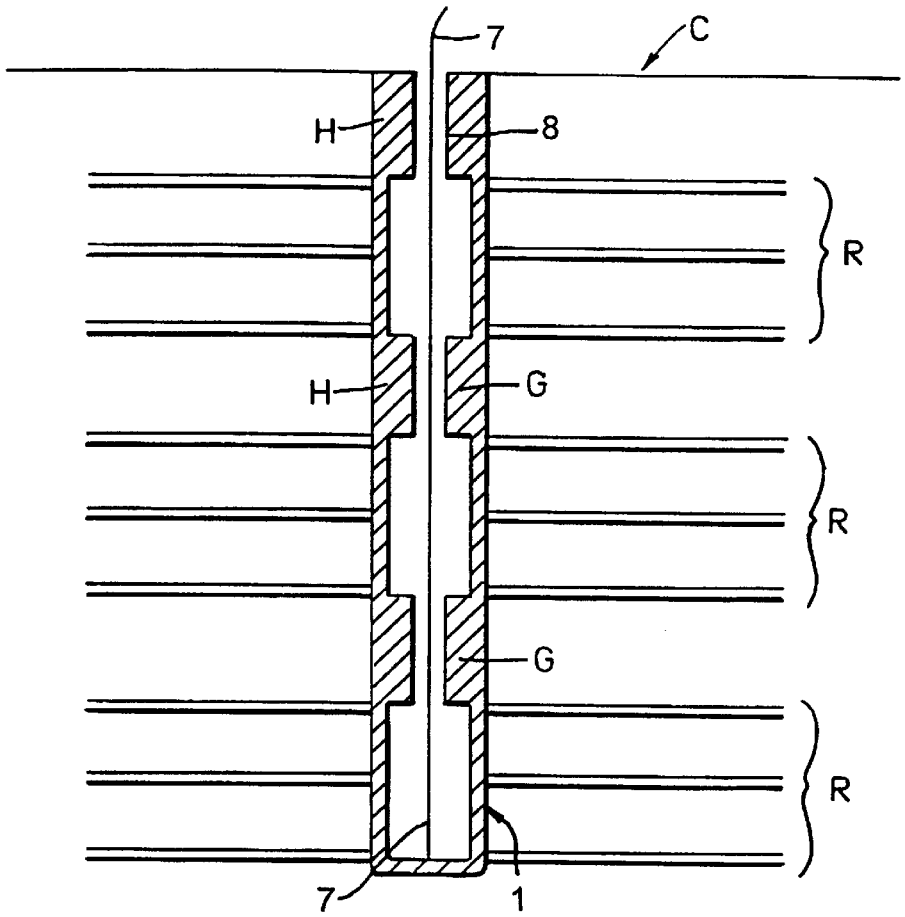
FIG. 4 is a cross section of a body of concrete being treated by a method according to the invention.

In use and as shown in FIG. 4, a hole H is drilled in the concrete C, not shown, to reach the reinforcement R to be protected the hole being only slightly larger in diameter than the electrode cylinder. The depth of the hole is determined by the geometry of the reinforcing bars in the concrete structure. The electrode is assembled by fitting the end caps in position and then inserted into the hole. The anode is then connected to the supply of direct current. The hole is filled with grout G. When gases are evolved by the chemical reactions they can escape into the cylinder and up through the plastic sheath 8 to the atmosphere. In this way they do not contact the concrete and hence do not influence the current carrying capacity of the electrode. As shown a vertical string of the anodes is formed.

The invention is not limited to the embodiment shown. For example the end caps may be omitted, and the method of connecting the feeder wire to the internal surface of the cylinder or other three dimensionally shaped electrode may be varied.

What is claimed is:

1. An electrode for use in electrochemically treating metal reinforced concrete by cathodic protection, the electrode comprising a hollow cylinder having a wall formed of porous material, the wall having an external surface and an internal surface, an electrical conductor in electrical contact with the internal surface and in use with a supply of electrical current, whereby the metal reinforcement is electrochemically treated to passivate the surface thereof and gases released thereby can pass out of the cylinder.

2. An electrode according to claim 1, including a sheath which extends beyond each end of the cylinder to convey gases released during the electrochemical treatment away from the electrode.

3. An electrode according to claim 1, wherein the porous material is titanium suboxide of the formula $TIO_x$ where x is 1.55 to 1.95.

4. An electrode according to claim 1, wherein the electrical conductor comprises a strip of metal which is held on a connector received within the cylinder and which urges the strip into contact with the internal surface of the cylinder.

5. A method of electrochemically treating metal reinforcement in metal reinforced concrete by cathodic protection, the method comprising the steps of:

a) forming a hole in the concrete to approach metal reinforcement contained therein;

b) locating in the hole and adjacent a portion of the metal reinforcement an electrode comprising a hollow cylinder having a wall formed of porous material, the wall having an external surface and an internal surface, an electrical conductor being in contact with the interior surface;

c) connecting the conductor to a supply of electrical current; and d) passing the current to cause an electrochemical reaction to protect the reinforcement cathodically and allowing gases released driving the treatment to pass out of the cylinder.

6. A method according to claim 5, including the step of locating a sheath in the cylinder so as to extend beyond at least one end thereof to convey gases released during the electrochemical reaction away from the electrode.

7. A method according to claim 5, wherein the step of forming the hole by drilling into the concrete is to a diameter only slightly larger than that of the electrode.

8. A method according to claim 5, wherein the step of forming a ladder of the electrode cylinders, each is associated with a different area of the metal reinforcement in the concrete, whereby gases released move up the ladder and into the atmosphere.

* * * * *